US012285837B2

(12) United States Patent
Yatsuzuka

(10) Patent No.: US 12,285,837 B2
(45) Date of Patent: Apr. 29, 2025

(54) WAFER SURFACE CHEMICAL DISTRIBUTION SENSING SYSTEM AND METHODS FOR OPERATING THE SAME

(71) Applicant: SANDISK TECHNOLOGIES LLC, Addison, TX (US)

(72) Inventor: Shota Yatsuzuka, Yokkaichi (JP)

(73) Assignee: Sandisk Technologies, Inc., Milpitas, CA (US)

( * ) Notice: Subject to any disclaimer, the term of this patent is extended or adjusted under 35 U.S.C. 154(b) by 626 days.

(21) Appl. No.: 17/529,842

(22) Filed: Nov. 18, 2021

(65) Prior Publication Data

US 2023/0150084 A1 May 18, 2023

(51) Int. Cl.
*B24B 37/04* (2012.01)
*B24B 37/20* (2012.01)

(52) U.S. Cl.
CPC ..... *B24B 37/042* (2013.01); *B24B 37/20* (2013.01)

(58) Field of Classification Search
None
See application file for complete search history.

(56) References Cited

U.S. PATENT DOCUMENTS

| | | | |
|---|---|---|---|
| 6,186,864 | B1 | 2/2001 | Fisher, Jr. et al. |
| 10,593,603 | B2 | 3/2020 | Izumi et al. |
| 2001/0044266 | A1 | 11/2001 | Katsuoka et al. |
| 2002/0013124 | A1 | 1/2002 | Tsujimura et al. |
| 2002/0045410 | A1 | 4/2002 | Sakurai et al. |
| 2002/0170572 | A1 | 11/2002 | Tomita et al. |
| 2004/0029489 | A1 | 2/2004 | Tsujimura et al. |
| 2004/0072499 | A1 | 4/2004 | Wakabayashi |
| 2004/0137823 | A1 | 7/2004 | Sakurai et al. |
| 2004/0235301 | A1 | 11/2004 | Wada et al. |
| 2004/0261944 | A1 | 12/2004 | Wakabayashi et al. |
| 2005/0159082 | A1 | 7/2005 | Sakurai et al. |
| 2006/0035563 | A1 | 2/2006 | Kalenian et al. |
| 2006/0199473 | A1 | 9/2006 | Suzuki et al. |
| 2007/0051619 | A1 | 3/2007 | Mazur et al. |
| 2007/0099426 | A1 | 5/2007 | Tsujimura et al. |
| 2007/0161338 | A1 | 7/2007 | Fujita |
| 2007/0212976 | A1 | 9/2007 | McReynolds et al. |
| 2007/0269986 | A1 | 11/2007 | Kalenian et al. |
| 2009/0042489 | A1 | 2/2009 | Fujita |

(Continued)

FOREIGN PATENT DOCUMENTS

| | | | |
|---|---|---|---|
| EP | 2980833 | A1 | 2/2016 |
| JP | 2005012175 | A | 1/2005 |
| JP | 2013162044 | A | 8/2013 |

OTHER PUBLICATIONS

Google Patents translation of JP2005012175A (Year: 2024).*

(Continued)

*Primary Examiner* — Eric W Golightly
(74) *Attorney, Agent, or Firm* — THE MARBURY LAW GROUP PLLC

(57) ABSTRACT

A method includes performing a chemical mechanical polishing (CMP) process on a wafer in a CMP apparatus, loading the wafer into a roll cleaning apparatus after performing the CMP process on the wafer, applying a fluid on a surface of the wafer; brushing the surface of the wafer with a rotating roll brush, and measuring a distribution of the fluid on the surface of the wafer while brushing the surface of the wafer.

6 Claims, 5 Drawing Sheets

(56) References Cited

U.S. PATENT DOCUMENTS

| | | | |
|---|---|---|---|
| 2009/0067959 | A1 | 3/2009 | Takahashi et al. |
| 2009/0209175 | A1 | 8/2009 | Saito et al. |
| 2009/0270015 | A1 | 10/2009 | D'Ambra et al. |
| 2010/0079554 | A1 | 4/2010 | Tsukamoto |
| 2012/0046781 | A1 | 2/2012 | Kalenian et al. |
| 2013/0220368 | A1 | 8/2013 | Ishibashi |
| 2016/0074988 | A1 | 3/2016 | Yamaguchi et al. |
| 2016/0099156 | A1 | 4/2016 | Yamaguchi et al. |
| 2018/0001342 | A1 | 1/2018 | Roberts et al. |
| 2018/0169826 | A1 | 6/2018 | Bankaitis et al. |
| 2018/0345316 | A1 | 12/2018 | Roberts et al. |
| 2019/0210177 | A1 | 7/2019 | Graves et al. |
| 2019/0287866 | A1 | 9/2019 | Izumi et al. |
| 2021/0008591 | A1 | 1/2021 | Lindefjeld et al. |
| 2021/0013071 | A1 | 1/2021 | Yamaguchi et al. |
| 2021/0272820 | A1 | 9/2021 | Ishibashi |

OTHER PUBLICATIONS

Notification of Transmittal of The International Search Report and Written Opinion of the International Searching Authority for International Patent Application No. PCT/US2022/029380, mailed Oct. 7, 2022, 10 pages.

U.S. Appl. No. 17/360,194, filed Jun. 28, 2021, Sandisk Technologies.

* cited by examiner

WAFER SURFACE CHEMICAL DISTRIBUTION SENSING SYSTEM AND METHODS FOR OPERATING THE SAME

FIELD

The present disclosure relates generally to the field of semiconductor manufacturing, and specifically to a wafer surface chemical distribution sensing system and methods for operating the same.

BACKGROUND

Chemical mechanical polishing (CMP) is a process that forms smooth and planarized surfaces by removing protruding portions of a structure having topographic height variations. CMP is employed during semiconductor manufacturing to planarize top surfaces of patterned structures of semiconductor devices.

SUMMARY

According to another aspect of the present disclosure, a chemical mechanical polishing (CMP) includes a polishing apparatus configured to polish a wafer by performing a chemical mechanical polishing (CMP) process thereupon; and a roll cleaning apparatus configured clean the wafer after performing the CMP process thereupon. The roll cleaning apparatus comprises a rotating roll brush configured to roll against a surface of the wafer during operation, a fluid supply system configured to apply a fluid on the surface of the wafer, and an array of liquid sensors configured to detect a distribution of the fluid on the surface of the wafer.

According to another aspect of the present disclosure, a method includes performing a chemical mechanical polishing (CMP) process on a wafer in a CMP apparatus, loading the wafer into a roll cleaning apparatus after performing the CMP process on the wafer, applying a fluid on a surface of the wafer, brushing the surface of the wafer with rotating roll brush, and measuring a distribution of the fluid on the surface of the wafer while brushing the surface of the wafer.

DETAILED DESCRIPTION

As discussed above, the embodiments of the present disclosure are directed to a wafer surface chemical distribution sensing system and methods for operating the same, the various aspects of which are described below.

A roll brush unit may be employed in a chemical mechanical polishing (CMP) system to provide a wafer cleaning process after a chemical mechanical polishing process. The wafer surface has a high density of dust and byproduct particles after the polishing process. Insufficient removal of the dust and the byproduct particles from the wafer surface can cause various types of failure within the metal interconnect structures or semiconductor devices located on the wafer. Thus, contamination in a roll brush unit may result in an increase in defects within the wafer.

Generally, uniform chemical distribution (e.g., distribution of a fluid including cleaning chemical(s)) within a roll brush unit is desired in performing an effective and uniform roll cleaning process. According to an aspect of the present disclosure, chemical distribution within a roll brush unit over a surface of a wafer can be controlled based on measurement of fluid thickness, shape and/or volume distribution over a surface of a wafer and adjustment of the flow rate and/or the application location of the cleaning fluid including the cleaning chemical. A sensing system for measuring local thicknesses, shape and/or volume of a cleaning fluid is employed to measure a two-dimensional distributional thickness distribution of the cleaning fluid.

Figure 1:
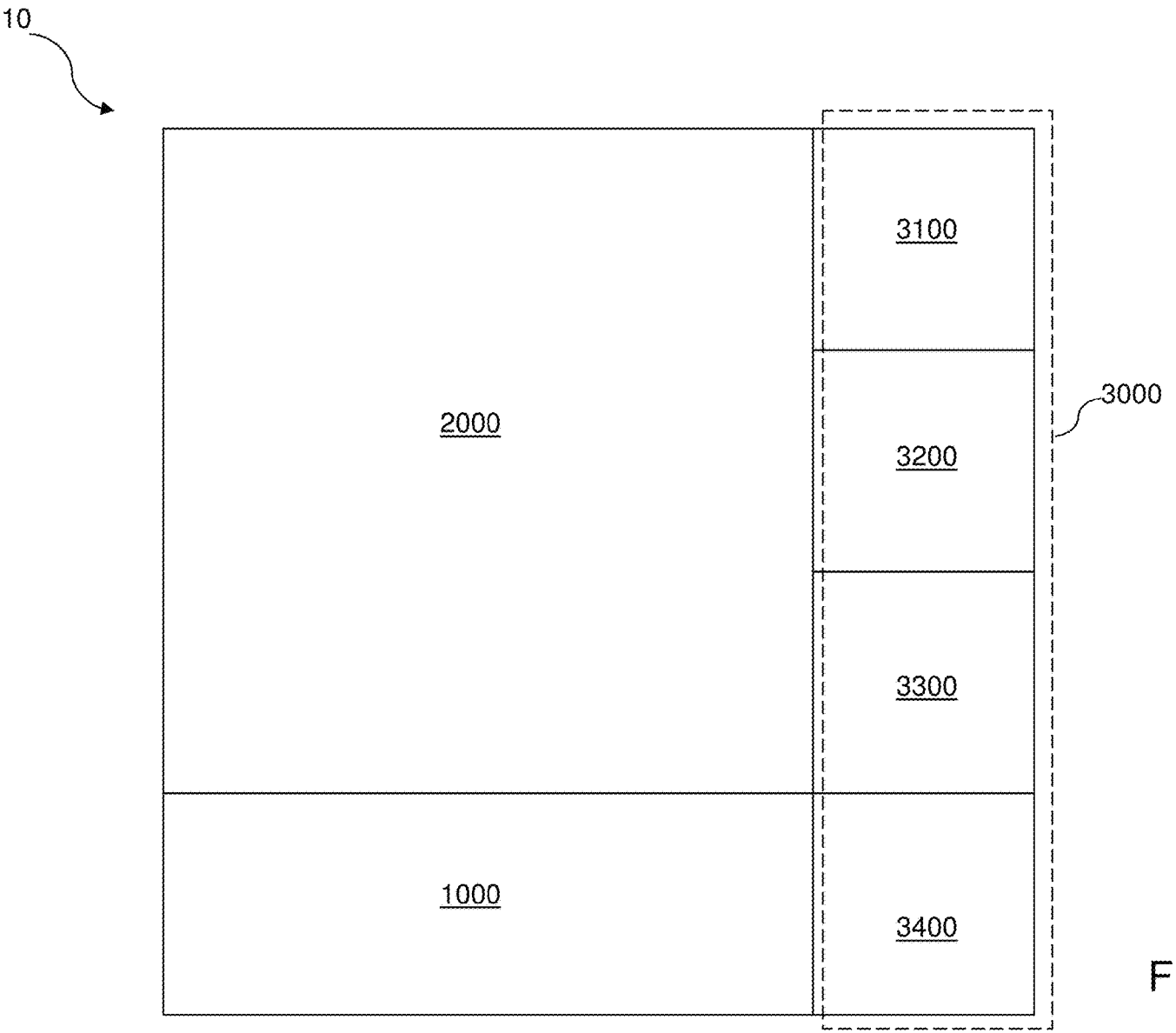
FIG. 1 is a to schematic view of an exemplary chemical mechanical polishing system according to an embodiment of the present disclosure.

Referring to FIG. 1, an exemplary chemical mechanical polishing (CMP) system 10 according to an embodiment of the present disclosure is illustrated in a plan view. The exemplary CMP system 10 may comprise a cluster tool which comprises a loading/unloading unit 1000, a CMP apparatus 2000, and a wafer cleaning apparatus 3000 include a set of cleaning chambers. The set of cleaning chambers may comprise, for example, a first cleaning chamber 3100, a second cleaning chamber 3200, a third cleaning chamber 3300, optional additional cleaning chambers (not shown), and a drying chamber 3400.

The loading/unloading unit 1000 is configured to mount at least one open cassette, at least one SMIF (Standard Manufacturing Interface) pod, and/or at least one FOUP (Front Opening Unified Pod). Each cassette, each SMIF pod, and/or each FOUP are configured to hold a plurality of wafers (e.g., silicon wafers), such as 25-30 wafers. The SMIF and the FOUP are an airtight container that can house a wafer cassette, and can be sealed to provide an airtight environment to wafers located within the wafer cassette. At least one transfer robot (not shown) can be provided within the loading/unloading unit 1000 and/or within the CMP apparatus 2000 to transport wafers from the loading/unloading unit 1000 to the CMP apparatus 2000. The loading/unloading unit 1000 may comprise a chamber of the cluster tool (i.e., of the system 10). The chamber may have walls and openings (e.g., load locks) to the CMP apparatus 2000 and the drying chamber 3400.

Figure 2:
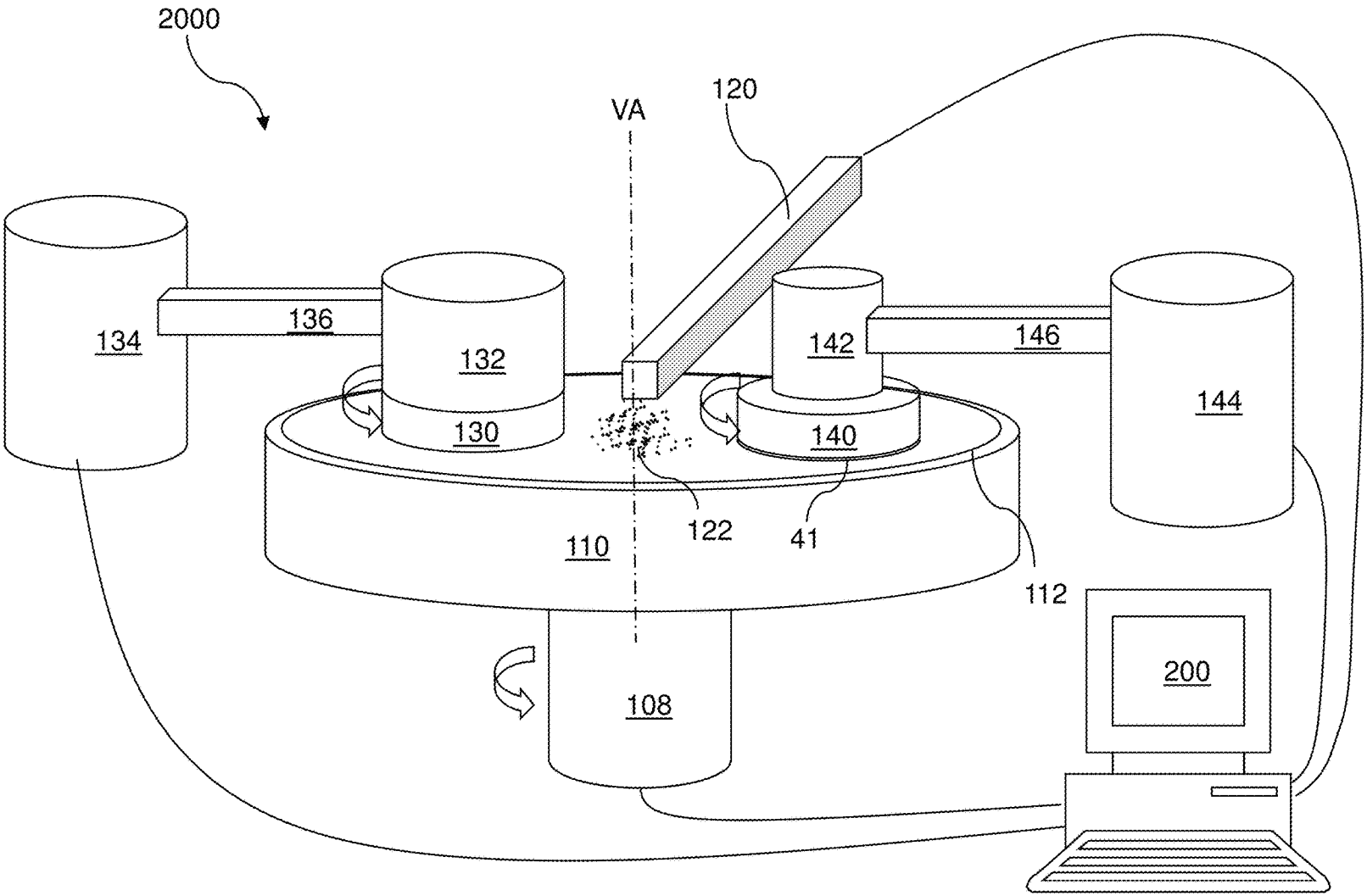
FIG. 2 is a schematic perspective view of a chemical mechanical polishing apparatus according to an embodiment of the present disclosure.

Referring to FIG. 2, the CMP apparatus 2000 within the exemplary CMP system 10 is illustrated. The CMP apparatus 2000 may comprise another chamber of the cluster tool (i.e., of the system 10). The chamber may have walls and openings (e.g., load locks) to the loading/unloading unit 1000 and the first cleaning chamber 3100.

The CMP apparatus 2000 includes a polishing pad 112 located on a top surface of a platen 110, a wafer carrier 140 that is configured to hold a work piece (such as a wafer 41) upside down, a slurry dispenser 120 that is configured to dispense slurry 122 over the top surface of the polishing pad 112, and a pad conditioning unit (130, 132) that can be used to condition the top surface of the polishing pad 112.

The platen 110 can have a generally cylindrical shape, and can have a circular top surface that can be large enough to accommodate the polishing pad 112. The polishing pad 112 can have a generally circular horizontal-cross-sectional shape with a diameter that is at least twice the diameter of the wafer 41. For example, in embodiments in which the diameter of the wafer 41 is 300 mm, the diameter of the polishing pad 112 can be at least 600 mm. In embodiments in which the diameter of the wafer 41 is 450 mm, the diameter of the polishing pad 112 can be at least 900 mm. Generally, the ratio of the diameter of the polishing pad 112 to the diameter of the wafer 41 can be in a range from 2 to 6, such as from 2.5 to 4, although greater or lesser ratios can be used. The polishing pad 112 can include a textured top surface that is employed as a polishing surface during a polishing operation. The polishing pad 112 of the embodiments of the present disclosure includes debris 124 extraction tunnels connected to perforation holes in an upper polishing pad layer. Methods for manufacturing the polishing pad 112 of the present disclosure, and the structural features of the polishing pad 112 are described below in more detail with accompanying drawings.

The platen 110 can be configured to rotate around a vertical axis (VA) passing through the geometrical center of the platen 110. For example, a platen motor assembly 108 can be provided underneath the platen 110, and can rotate the platen 110 around the vertical axis (VA) passing through the geometrical center of the platen 110. As used herein, a geometrical center of an object refers to a center of mass of a hypothetical object occupying the same volume as the object and having a uniform density throughout. If an object has a uniform density, the geometrical center coincides with the center of gravity. The platen 110 can be configured to provide a rotational speed in a range from 10 revolutions per minute to 240 revolutions per minute, although faster or slower rotational speed can be used.

The wafer carrier 140 can be configured to hold the wafer 41 on a bottom surface thereof. Thus, the wafer carrier 140 can press the wafer 41 onto the top surface of the polishing pad 112. In one embodiment, the wafer carrier 140 can include a vacuum chuck configured to provide suction to the backside of the wafer 41. In one embodiment, differential suction pressures can be applied across different backside areas of the wafer 41. For example, the suction pressure applied to the center portion of the wafer 41 can be different from the suction pressure applied to the peripheral portion of the wafer 41 to provide uniform polishing rate across the entire area of the front side of the wafer 41 that contacts the polishing pad 112. In one embodiment, the wafer carrier 140 can include a retaining ring having an annular shape and configured to hold the wafer 41 therein so that the wafer 41 does not slide out from underneath the wafer carrier 140.

A polishing head 142 can be provided over the wafer carrier 140. The polishing head 142 can include a rotation mechanism that provides rotation to the wafer carrier 140. In some embodiments, a gimbal mechanism can be provided between the rotation mechanism and the wafer carrier 140 so that the wafer carrier 140 tilts in a manner that provides maximum physical contact between the entire front surface of the wafer 41 and the polishing pad 112. The combination of the polishing head 142 and the wafer carrier 140 constitutes a wafer polishing unit (140, 142) that positions and rotates the wafer 41 in a manner that induces polishing of material portions on the front side of the wafer 41 through abrasion caused by sliding contact with the top surface of the polishing pad 112.

In one embodiment, the wafer 41 and the wafer carrier 140 can rotate around the vertical axis (not illustrated) passing through the geometrical center of the wafer carrier 140. A polishing pivot pillar structure 144 can be affixed to a frame (not shown) of the CMP apparatus such that the polishing pivot pillar structure 144 can rotate around a vertical axis (not illustrated) passing through the geometrical center of the polishing pivot pillar structure 144. The vertical axis passing through the geometrical center of the polishing pivot pillar structure 144 can be stationary relative to the frame of the CMP apparatus.

A polishing arm 146 mechanically connects the polishing head 142 to the polishing pivot pillar structure 144. Thus, upon rotation of the polishing pivot pillar structure 144 around the vertical axis passing through the geometrical center of the polishing pivot pillar structure 144, the polishing arm 146 can rotate around the vertical axis passing through the geometrical center of the polishing pivot pillar structure 144. The polishing head 142 can move around the vertical axis passing through the geometrical center of the polishing pivot pillar structure 144 over the polishing pad 112. Lateral movement of the wafer polishing unit (140, 142) over the polishing pad 112 can enhance uniformity of polish rate across the wafer 41 during the CMP process.

The slurry dispenser 120 can be configured to dispense the slurry 122 over the top surface of the polishing pad 112. The slurry 122 can include any slurry known in the art, such as commercially available slurries for chemical mechanical polishing processes.

The pad conditioning unit (130, 132) can be used to precondition the polishing pad 112 prior to and/or during the CMP process that is used to polish material portions from the front surface of the wafer 41 that contacts the top surface of the polishing pad 112. In one embodiment, the pad conditioning unit (130, 132) can include a pad conditioning disk 130 and a conditioning head 132 that is configured to hold the pad conditioning disk 130. The pad conditioning disk 130 includes an abrasive bottom surface that can precondition the top surface of the polishing pad 112. Typically, the abrasive bottom surface of the pad conditioning disk 130 embeds abrasive particles, such as diamond particles. The pad conditioning disk 130 can be attached to the conditioning head 132 in a manner that provides rotation of the pad conditioning disk around a vertical axis (not shown) passing through the geometrical center of the pad conditioning disk 130 without falling out from the conditioning head 132.

A conditioner pivot pillar structure 134 can be affixed to a frame (not shown) of the CMP apparatus such that the conditioner pivot pillar structure 134 can rotate around a vertical axis (not shown) passing through the geometrical center of the conditioner pivot pillar structure 134. The vertical axis passing through the geometrical center of the conditioner pivot pillar structure 134 can be stationary relative to the frame of the CMP apparatus.

A pad conditioner arm 136 mechanically connects the conditioning head 132 to the conditioner pivot pillar structure 134. A pad conditioner arm 136 mechanically connects the conditioning head 132 to the conditioner pivot pillar structure 134. Thus, upon rotation of the conditioner pivot pillar structure 134 around the vertical axis passing through the geometrical center of the conditioner pivot pillar structure 134, the pad conditioner arm 136 can rotate around the vertical axis passing through the geometrical center of the conditioner pivot pillar structure 134. The conditioning head 132 can move around the vertical axis passing through the geometrical center of the conditioner pivot pillar structure 134 over the polishing pad 112. Lateral movement of the pad conditioning unit (130, 132) over the polishing pad 112 can enhance uniformity of the surface condition of the polishing pad 112 after the pad pre-conditioning process.

The CMP apparatus 2000 of the embodiments of the present disclosure can include a process controller 200 electrically connected (e.g., via wired and/or wireless connections) to electrical components that control movement of various mechanical parts of the CMP apparatus. For example, the process controller 200 can be electrically connected to, and can be configured to control operation of, each of the platen motor assembly 108, the polishing pivot pillar structure 144, the wafer polishing unit (140, 142), the conditioner pivot pillar structure 134, the pad conditioning unit (130, 132), and the slurry dispenser 120. For example, the process controller 200 can control the rotational speed of the platen 110, the polishing pivot pillar structure 144, the wafer carrier 140, the conditioner pivot pillar structure 134, and the pad conditioning disk 130, and can control the location of the slurry dispensation point and the rate of slurry dispensation.

Generally, the CMP apparatus 2000 according to various embodiments can include a polishing pad 112 located on a top surface of a platen 110 configured to rotate around a vertical axis VA passing through the platen 110, a wafer carrier 140 that holds a wafer 41 and facing the polishing pad 112, a slurry dispenser 120 configured to dispense slurry 122 over the polishing pad 112, and a process controller 200 configured to control operation of components within the wafer carrier 140 and other components of the CMP apparatus. For example, the process controller 200 may control the rotation speed of the platen 110, the rotation speed of the wafer carrier 140, and/or the downforce that the wafer carrier 140 applies to the polishing pad 112. The CMP apparatus may include an assembly of a conditioning head 132 and a pad conditioning disk 130 that is configured to condition the top surface of the polishing pad 112.

Referring back to FIG. 1, the CMP apparatus 2000 and/or the wafer cleaning apparatus 3000 may comprise additional transfer robots configured to transfer wafers from the CMP apparatus 2000 into the wafer cleaning apparatus 3000 and/or between the various cleaning chambers within the wafer cleaning apparatus 3000. The wafers are transferred via openings (e.g., load locks) between the chambers.

The first cleaning chamber 3100, the second cleaning chamber 3200, the third cleaning chamber 3300, and/or the additional cleaning chambers (not shown) may comprise various types of cleaning chambers, which may include, for example, a roll cleaning apparatus, a pen cleaning chamber, a buff processing chamber, a megasonic cleaning chamber, and/or additional types of processing chambers. The order of the various types of cleaning chambers may be selected to provide effective cleaning to each wafer. Generally, large particles are removed first and fine particles are removed at later cleaning processes. Each wafer can be transferred into the drying chamber 3400 after performing all cleaning processes, and upon drying, can be transferred to the loading/unloading unit 1000 by a transfer robot.

Figure 3A:
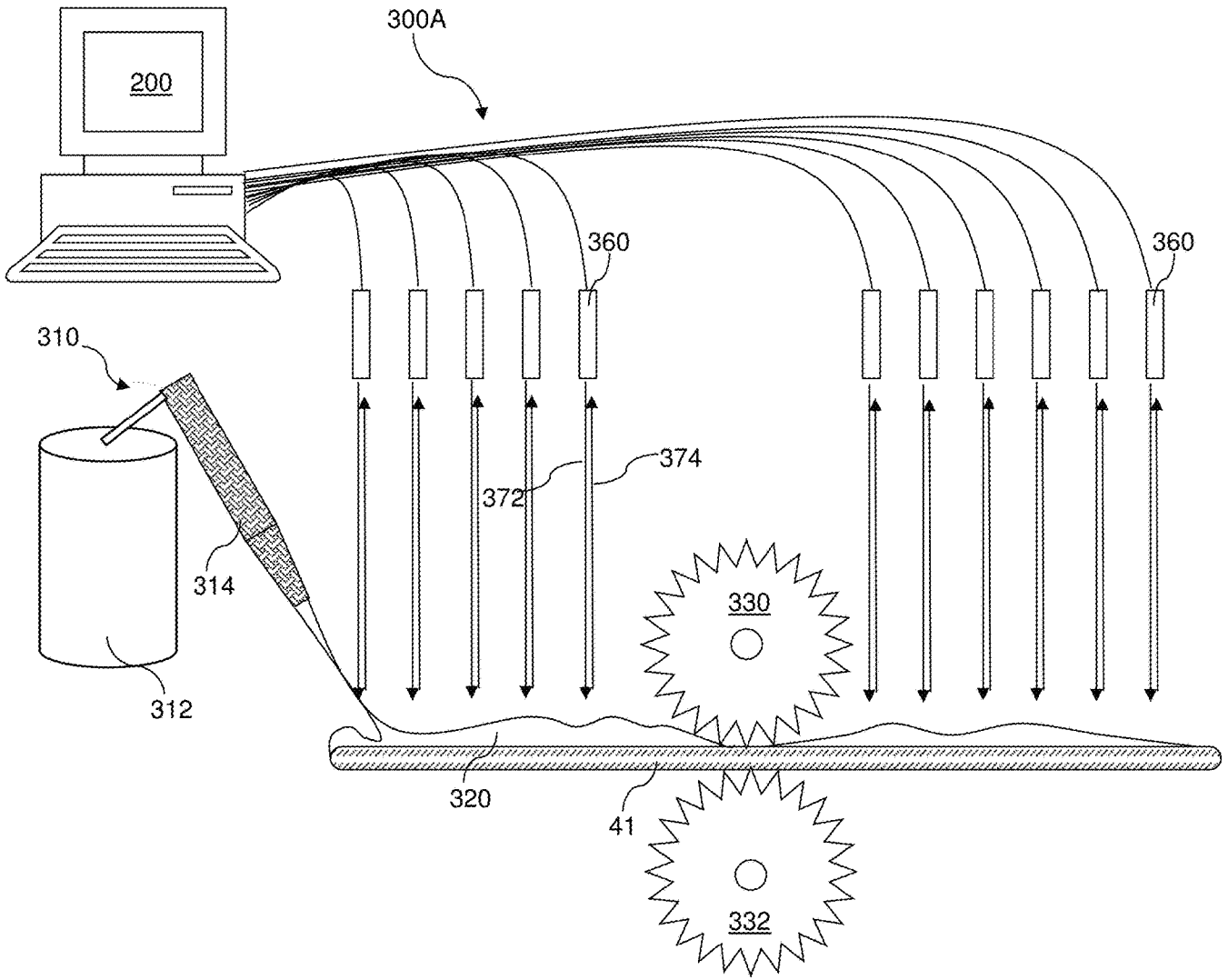
FIG. 3A is a schematic vertical cross-sectional view of a first exemplary roll cleaning apparatus according to an embodiment of the present disclosure.
Figure 4:
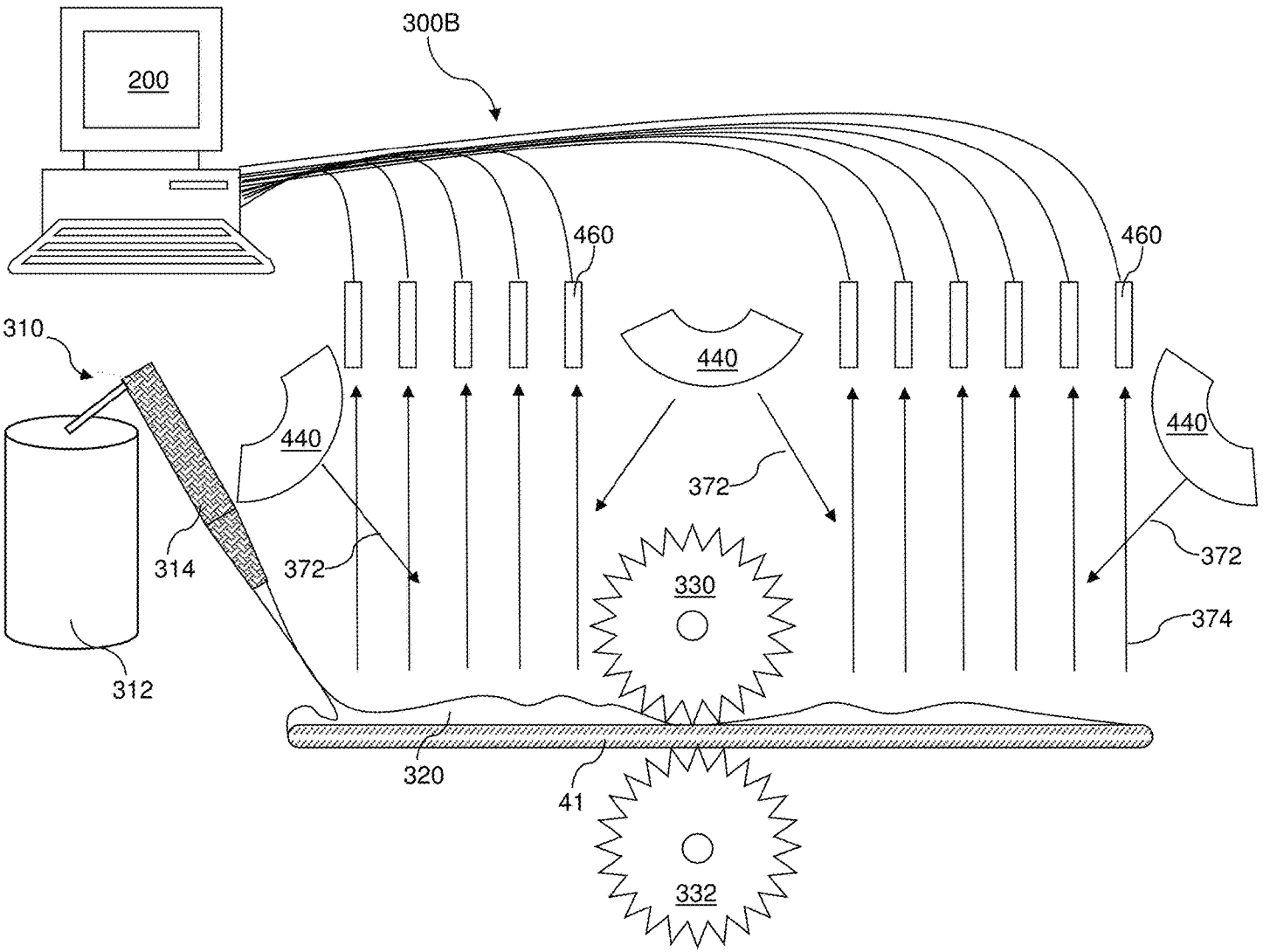
FIG. 4 is a schematic vertical cross-sectional view of a second exemplary roll cleaning apparatus according to an embodiment of the present disclosure.

According to an aspect of the present disclosure, at least one of the cleaning chambers, such as at least one of the first cleaning chamber 3100, the second cleaning chamber 3200, or the third cleaning chamber 3300, comprises a roll cleaning apparatus. FIG. 3A is a schematic vertical cross-sectional view of a first exemplary roll cleaning apparatus 300A according to an embodiment of the present disclosure. FIG. 4 is a schematic vertical cross-sectional view of a second exemplary roll cleaning apparatus 300B according to another embodiment of the present disclosure. The apparatus 300A or 300B may be located in one of the first cleaning chamber 3100, the second cleaning chamber 3200, or the third cleaning chamber 3300.

Figure 3B:
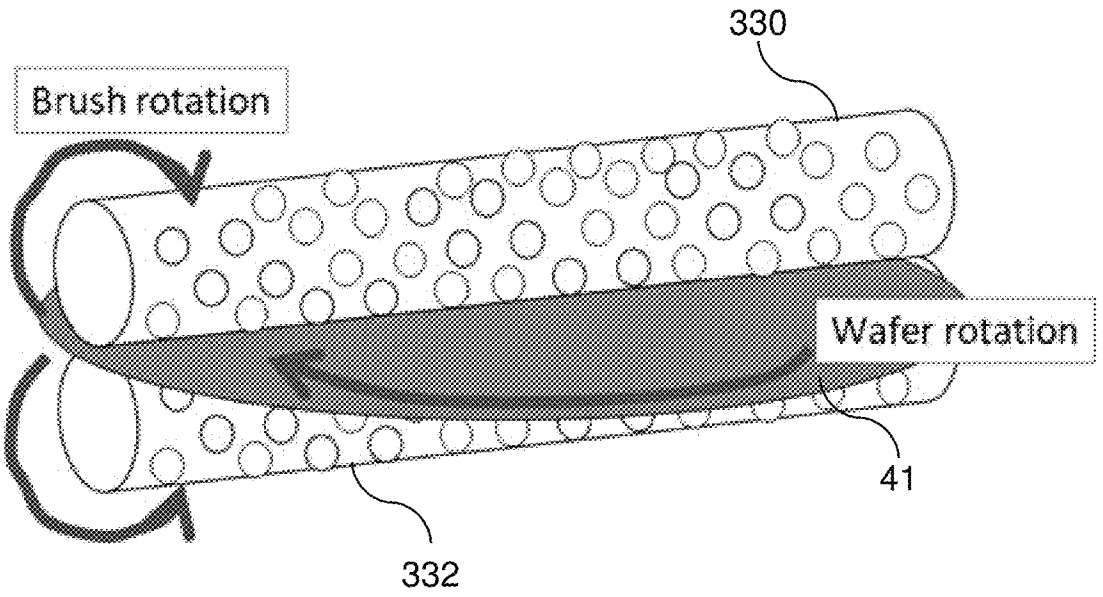
FIG. 3B is a schematic perspective view of the brush region of the first exemplary roll cleaning apparatus of FIG. 3A according to an embodiment of the present disclosure

Referring collectively to FIGS. 3A, 3B and 4, a roll cleaning apparatus (300A or 300B) of the embodiments of the present disclosure can include a fluid supply system 310 configured to apply a fluid 320 on the surface of the wafer 41, a rotating roll brush 330 configured to roll against a surface of a wafer 41 during operation, and an array of liquid sensors (360 or 460) configured to detect a two-dimensional and/or a three-dimensional distribution of the fluid 320 on the surface of the wafer 41 in areas that are not covered by the rotating roll brush 330.

In one embodiment, the fluid supply system 310 comprises a fluid storage container 312 (e.g., cleaning chemical tank or barrel) that is fluidly connected (e.g., via a tube, pipe or another conduit) to at least one nozzle 314 configured to spray the fluid 320 onto the surface of the wafer 41. As shown in FIG. 3B, the first rotating roll brush 330 is configured to roll against the front surface of a wafer 41. In one embodiment, the roll cleaning apparatus (300A or 300B) further comprises a second rotating roll brush 332 configured to roll against a back surface of the wafer 41 during the cleaning operation. The brushes (330, 332) roll in opposite directions from each other, as shown in FIG. 3B. Furthermore, the wafer 41 may also rotate between the brushes (330, 332) during the cleaning operation.

Generally, the rotating roll brushes (330, 332) comprise a material having a Young's modulus that is less than 1% of a Young's modulus of silicon oxide (which is about 35 GPa). For example, the rotating roll brushes (330, 332) may comprise a polymer material or resin, such as polyvinylchloride (PVC).

In one embodiment, the array of liquid sensors comprises an array of ultrasonic sensors (360 or 460). In one embodiment, each of the ultrasonic sensors (360 or 460) can be configured to measure a local thickness of the fluid at a respective measurement location based on a measured intensity of an ultrasound wave 374 (i.e., a reflected ultrasound wave) from the respective measurement location. Each measurement location can be located on the top surface of the wafer 41. The shape and/or volume of the fluid may be calculated by the controller 200 based on the fluid thickness measurements at different locations on the top surface of the wafer 41. In one embodiment, each of the ultrasonic sensors (360 or 460) comprises a respective directional ultrasonic sensor that increases attenuation of an incident ultrasonic wave as a function of an angle between a sensor alignment direction of a respective ultrasonic sensor (360 or 460) and an incidence direction of the incident ultrasonic wave. The sensor alignment direction is the direction connecting the respective ultrasonic sensor (360 or 460) and the respective measurement location. In one embodiment, the sensor alignment direction may be a downward vertical direction, or a downward direction with a taper angle in a range from 0 degree to 30 degrees with respective to a vertical direction. In one embodiment, the sensitivity of the ultrasonic sensors (360 or 460) may be highly directional. In an illustrative example, the sensitivity of the ultrasonic sensors (360 or 460) may decrease by a factor of 2~4 decibels per degree in angular offset from the direction of the maximum sensitivity up to an angular offset of about 10 degrees.

In an embodiment illustrated in FIG. 3A, the roll cleaning apparatus 300A comprises an array of integrated ultrasound emitter-sensor assemblies 360. Each of the integrated ultrasound emitter-sensor assemblies 360 comprises a combination of an ultrasound emitter and an ultrasonic sensor that is a component (i.e., an element) of the array of ultrasonic sensors. In this case, the array of ultrasonic sensors comprises components of the array of integrated ultrasound emitter-sensor assemblies 360.

In one embodiment, each of the ultrasonic emitters in the array of integrated ultrasound emitter-sensor assemblies 360 may be configured to emit a respective directed ultrasonic wave at a respective measurement location. In one embodiment, each of the integrated ultrasound emitter-sensor assemblies 360 may be configured to determine, and to output, a ratio of a magnitude of a detected ultrasound wave 374 from a respective ultrasonic sensor (i.e., the ultrasonic sensor of the integrated ultrasound emitter-sensor assembly 360) to a magnitude of an emitted ultrasound wave 372 from a respective ultrasound emitter (i.e., the ultrasound emitter of the integrated ultrasound emitter-sensor assembly 360).

In one embodiment, each of the integrated ultrasound emitter-sensor assemblies 360 may be calibrated prior to operation so that the output is proportional to the ratio of the magnitude of the detected ultrasound wave 374 as detected by the ultrasonic sensor to the magnitude of the emitted ultrasound wave 372 from the ultrasound emitter. Generally, the greater the thickness of the fluid 320 at a measurement location, the lower the ratio of the magnitude of the detected ultrasound wave 374 as detected by a ultrasonic sensor to the magnitude of the emitted ultrasound wave 372 from a ultrasound emitter within a same integrated ultrasound emitter-sensor assembly 360.

In one embodiment, each of the ultrasonic emitters in the array of the integrated ultrasound emitter-sensor assemblies 360 may be configured to sequentially emit ultrasound waves at multiple frequencies. The emission frequencies of the ultrasonic emitters may be greater than 20 kHz and/or 30 kHz and/or 50 kHz, and may be less than 10 MHz and/or 1 MHz and/or 100 kHz.

In an embodiment illustrated in FIG. 4, the roll cleaning apparatus 300B comprises an array of ultrasonic sensors 460 that are not integrated with ultrasound emitters 400. In this case, the roll cleaning apparatus 300B comprises at least one ultrasound emitter 440 configured to emit an ultrasound wave 372 toward the surface of the wafer 41. The at least one ultrasound emitter 440 can be located at different locations than the array of ultrasonic sensors 460.

In one embodiment, each ultrasonic emitter 440 may be configured to sequentially emit ultrasound waves at multiple frequencies. The emission frequencies of the ultrasonic emitters 440 may be greater than 20 kHz and/or 30 kHz and/or 50 kHz, and may be less than 10 MHz and/or 1 MHz and/or 100 kHz.

Generally, the operation of the various components of the roll cleaning apparatus (300A or 300B) can be controlled by the process controller 200. For example, the output from the array of ultrasonic sensors (360, 460) can be transmitted to the process controller, and a map of the two-dimensional distribution of the thickness of the fluid 320 can be generated by the process controller 200 employing a model-based calculation. In this case, a thickness distribution model that correlates the outputs from the array of ultrasonic sensors (360, 460) to a two-dimensional thickness distribution of the fluid 320 may be employed to generate the map of the two-dimensional distribution of the thickness of the fluid 320. Furthermore, the three-dimensional volume and/or shape distribution may also be calculated by the process controller 200 from the two-dimensional distribution of the thickness of the fluid 320. The flow rate of the fluid 320 out of the nozzle 314 and/or the application direction of the nozzle 314 can be adjusted by the process controller 200 based on the chemical distribution (e.g., based on calculated map of the two-dimensional distribution of the thickness of the fluid 320, etc.) to provide a more uniform roll clean process.

Referring to all drawings and according to various embodiments of the present disclosure, a method of operating a chemical mechanical polishing (CMP) system is provided. A CMP process can be performed on a wafer 41 in the CMP apparatus 2000. The wafer 41 is then loaded into the roll cleaning apparatus (300A or 300B) after performing the CMP process on the wafer 41. A fluid 320 can be applied onto a surface of the wafer 41. The surface of the wafer 41 is brushed with a rotating roll brush 330. The distribution of the fluid 320 on the surface of the wafer 41 is measured while brushing the surface of the wafer 41.

In one embodiment, the fluid 320 comprises a chemical cleaning fluid which is applied to the surface of the wafer 41 through a nozzle 314, and the flow rate of the fluid 320 through the nozzle 314 can be adjusted based on the measured distribution of the fluid 320 to provide substantially uniform thickness distribution for the fluid 320 over the wafer 41. In one embodiment, the direction of the nozzle 314 may be adjusted based on the measured distribution of the fluid 320. Alternatively, or in addition, the brush (330, 332) rotation speed and/or the wafer 41 rotation speed may also be adjusted based on the measured distribution of the fluid 320.

In one embodiment, the distribution of the fluid 320 can be measured by measuring a thickness distribution of the fluid 320 on the surface of the wafer 41 in areas that are not covered by the rotating roll brush 330.

In one embodiment, the distribution of the fluid 320 is measured ultrasonically. In one embodiment, the roll cleaning apparatus 300A of FIG. 3A comprises an array of integrated ultrasound emitter-sensor assemblies 360. Each of the integrated ultrasound emitter-sensor assemblies 360 comprises a combination of an ultrasound emitter and an ultrasonic sensor. In another embodiment, the roll cleaning apparatus 300B of FIG. 4 comprises at least one ultrasound emitter 440 which emits an ultrasound wave 372 toward the surface of the wafer and an array of ultrasonic sensors 460 which ultrasonically measure the distribution of the fluid 320.

Embodiments of the present disclosure provide methods for detecting the distribution of the cleaning chemical fluid on a surface of a wafer 41. The distribution can include the thickness of the fluid 320, the shape of the fluid 320, the volume of the fluid 320, and/or other spatial distribution of the fluid 320, etc. The array of liquid sensors can output the measurement data as synthesized images or as numerical data. In an illustrative example, in case insufficient amount of fluid 320 on the surface of the wafer 41 is detected at wafer edge regions, at least one nozzle 314 can be repositioned, or the flow rate of the fluid 320 through at least one nozzle 314 can be increased, so that the amount of the fluid 320 at the wafer edge region can be increased.

Continuous monitoring of the distribution of the fluid 320 can be performed so that application of the fluid 320 from the nozzle(s) 314 can be continuously adjusted throughout the roll clean process. The apparatuses and the methods of the embodiments of present disclosure may be employed to continuously monitor and adjust the fluid distribution on the surface of the wafer 41 in real time to improve the post CMP wafer cleaning process.

Although the foregoing refers to particular preferred embodiments, it will be understood that the disclosure is not so limited. It will occur to those of ordinary skill in the art that various modifications may be made to the disclosed embodiments and that such modifications are intended to be within the scope of the disclosure. Where an embodiment employing a particular structure and/or configuration is illustrated in the present disclosure, it is understood that the present disclosure may be practiced with any other compatible structures and/or configurations that are functionally equivalent provided that such substitutions are not explicitly forbidden or otherwise known to be impossible to one of ordinary skill in the art. All of the publications, patent applications and patents cited herein are incorporated herein by reference in their entirety.

What is claimed is:

1. A method, comprising:

performing a chemical mechanical polishing (CMP) process on a wafer in a CMP apparatus;

loading the wafer into a roll cleaning apparatus after performing the CMP process on the wafer, wherein the roll cleaning apparatus comprises an array of integrated ultrasound emitter-sensor assemblies, wherein each of the integrated ultrasound emitter-sensor assemblies comprises a combination of an ultrasound emitter and an ultrasonic sensor;

applying a fluid on a surface of the wafer;

brushing the surface of the wafer with a rotating roll brush;

ultrasonically measuring a distribution of the fluid on the surface of the wafer while brushing the surface of the wafer; and generating a map of a two-dimensional distribution of a thickness of the fluid by ultrasonically measuring the distribution of the fluid on the surface of the wafer while brushing the surface of the wafer employing outputs from the array of integrated ultrasound emitter-sensor assemblies.

2. The method of claim 1, wherein the step of ultrasonically measuring the distribution of the fluid comprises measuring a local thickness of the fluid at a respective measurement location based on a measured intensity of an ultrasound wave from the respective measurement location.

3. The method of claim 1, further comprising calculating a three-dimensional volume distribution of the fluid from the map of the two-dimensional distribution of the thickness of the fluid employing the process controller.

4. A method, comprising:

performing a chemical mechanical polishing (CMP) process on a wafer in a CMP apparatus;

loading the wafer into a roll cleaning apparatus after performing the CMP process on the wafer, wherein the roll cleaning apparatus comprises an array of integrated ultrasound emitter-sensor assemblies, wherein each of the integrated ultrasound emitter-sensor assemblies comprises a combination of an ultrasound emitter and an ultrasonic sensor;

applying a fluid on a surface of the wafer;

brushing the surface of the wafer with a rotating roll brush;

ultrasonically measuring a distribution of the fluid on the surface of the wafer while brushing the surface of the wafer; and calibrating each of the integrated ultrasound emitter-sensor assemblies to provide a respective output which is proportional to a ratio of a magnitude of a detected ultrasound wave as detected by a ultrasonic sensor within a respective one of the integrated ultrasound emitter-sensor assemblies to a magnitude of an emitted ultrasound wave from an ultrasound emitter within the respective one of the integrated ultrasound emitter-sensor assemblies.

5. A method, comprising:

performing a chemical mechanical polishing (CMP) process on a wafer in a CMP apparatus;

loading the wafer into a roll cleaning apparatus after performing the CMP process on the wafer;

applying a fluid on a surface of the wafer;

brushing the surface of the wafer with a rotating roll brush; and ultrasonically measuring a distribution of the fluid on the surface of the wafer while brushing the surface of the wafer;

wherein:

the roll cleaning apparatus comprises an array of integrated ultrasound emitter-sensor assemblies;

each of the integrated ultrasound emitter-sensor assemblies comprises a combination of an ultrasound emitter and an ultrasonic sensor; and the ultrasound sensors within the array of integrated ultrasound emitter-sensor assemblies comprise directional ultrasonic sensors that increase attenuation of an incident ultrasonic wave as a function of an angle between a sensor alignment direction of a respective ultrasonic sensor and an incidence direction of the incident ultrasonic wave.

6. The method of claim 5, wherein each of the ultrasound sensors has a respective sensor alignment direction which is a downward vertical direction, or a downward direction with a taper angle in a range from 0 degree to 30 degrees with respective to a vertical direction.

* * * * *